US010190305B2

(12) United States Patent
Howson

(10) Patent No.: US 10,190,305 B2
(45) Date of Patent: Jan. 29, 2019

(54) DRAINAGE SYSTEM

(71) Applicant: Elfblend Pty Ltd, Southport, Queensland (AU)

(72) Inventor: Leslie Lawrence Howson, Ashmore (AU)

(73) Assignee: Elfblend Pty Ltd (AU)

( * ) Notice: Subject to any disclaimer, the term of this patent is extended or adjusted under 35 U.S.C. 154(b) by 28 days.

(21) Appl. No.: 15/220,227

(22) Filed: Jul. 26, 2016

(65) Prior Publication Data

US 2018/0030713 A1 Feb. 1, 2018

(51) Int. Cl.
*E02F 5/04* (2006.01)
*E03F 5/04* (2006.01)

(52) U.S. Cl.
CPC ..... *E03F 5/0408* (2013.01)

(58) Field of Classification Search
CPC ..... E03F 5/0408
USPC ..... 4/679, 613; 210/163–166
See application file for complete search history.

(56) References Cited

U.S. PATENT DOCUMENTS

| | | | |
|---|---|---|---|
| 1,646,994 | A | 10/1927 | Decker |
| 1,749,878 | A | 3/1930 | Fleming |
| 2,591,632 | A | 4/1952 | Stavoe et al. |
| 2,626,674 | A | 1/1953 | Boosey |
| 2,705,542 | A | 4/1955 | Yavitch |
| 2,783,852 | A | 3/1957 | Sisk |
| 2,859,452 | A | 11/1958 | Seewack |
| D205,276 | S | 7/1966 | Kort |
| 3,311,391 | A | 3/1967 | Harrell |
| 3,800,486 | A | 4/1974 | Harvey |
| 4,207,632 | A | 6/1980 | Savell |
| 4,212,486 | A | 7/1980 | Logsdon |
| 4,457,030 | A | 7/1984 | Burry |
| 4,883,590 | A | 11/1989 | Papp |
| 4,964,180 | A | 10/1990 | Harbeke |
| 5,124,031 | A | 6/1992 | Dallmer |

(Continued)

FOREIGN PATENT DOCUMENTS

| | | |
|---|---|---|
| AU | 721387 | 7/1998 |
| CN | 202672275 | 1/2013 |

(Continued)

OTHER PUBLICATIONS

Wondercap installation manual.

*Primary Examiner* — Christine Skubinna
(74) *Attorney, Agent, or Firm* — Perkins Coie LLP

(57) ABSTRACT

A drainage system (1) for installation in a wet area such as a shower stall. The drainage system (1) comprises an outer drainage conduit (2) adapted to extend within a subfloor (100) of a wet area and an inner drainage conduit (3). The conduit (2) comprises a rim (20) and a pipe body (21). The inner drainage conduit (3) also comprises a rim (30) and a pipe body (31). The rim (30) and pipe body (31) are nestable within the outer drainage conduit (2). When nested, the pipe bodies (21, 31) are adapted to be connectively sealed together using sealant, the rims (20, 30) are adapted to hold a waterproofing membrane (107) between the rims (20, 30,) and to be connectively sealed in a water-tight manner to the waterproofing membrane (107) using sealant or, in the absence of a waterproofing membrane (107), the rims (20, 30) are adapted to be connectively sealed together using sealant in a water-tight manner.

10 Claims, 10 Drawing Sheets

(56) References Cited

U.S. PATENT DOCUMENTS

| | | | | |
|---|---|---|---|---|
| 5,377,361 | A | 1/1995 | Piskula | |
| D402,354 | S | 12/1998 | Strong et al. | |
| 5,878,448 | A | 3/1999 | Molter | |
| 5,921,282 | A | 7/1999 | Castillo et al. | |
| 5,996,134 | A | 12/1999 | Senninger | |
| 6,076,559 | A | 6/2000 | Castillo et al. | |
| 6,085,362 | A | 7/2000 | Huber | |
| 6,092,244 | A | 7/2000 | Rizzardi et al. | |
| D441,848 | S | 5/2001 | Huang | |
| 6,595,243 | B2 | 7/2003 | Tarr | |
| 6,755,966 | B1 | 6/2004 | Reed | |
| 6,799,606 | B1 * | 10/2004 | Howson | E04D 13/0409 138/89 |
| D613,828 | S | 4/2010 | Kinchen | |
| 8,043,497 | B2 * | 10/2011 | Silverstein | E03F 5/0407 210/164 |
| D657,848 | S | 4/2012 | Howson | |
| 9,848,742 | B2 * | 12/2017 | Phillips | E03F 5/0408 |
| 2004/0128752 | A1 | 7/2004 | Atkins et al. | |
| 2007/0177942 | A1 | 8/2007 | Meyers | |
| 2007/0209109 | A1 | 9/2007 | Meyers | |
| 2008/0022455 | A1 | 7/2008 | McAlpine | |
| 2008/0229494 | A1 | 9/2008 | DeGooyer et al. | |
| 2008/0277324 | A1 | 11/2008 | Meyers | |
| 2009/0077735 | A1 | 3/2009 | Dallmer | |
| 2010/0005581 | A1 | 1/2010 | McAlpine | |
| 2010/0024107 | A1 | 2/2010 | Stimpson | |
| 2010/0126917 | A1 | 5/2010 | Wroblewski | |
| 2010/0133159 | A1 | 6/2010 | Priester | |
| 2010/0235982 | A1 | 9/2010 | Stimpson | |
| 2010/0288685 | A1 | 11/2010 | Meyers | |
| 2011/0296606 | A1 | 12/2011 | Wedi | |
| 2012/0005873 | A1 | 1/2012 | DeGooyer | |
| 2012/0018362 | A1 | 1/2012 | Swanston | |
| 2013/0061387 | A1 | 3/2013 | Stetson et al. | |
| 2013/0318705 | A1 | 12/2013 | Plank et al. | |
| 2014/0157514 | A1 | 6/2014 | Cook | |
| 2016/0177561 | A1 * | 6/2016 | DeJesus | A47K 3/40 52/741.4 |

FOREIGN PATENT DOCUMENTS

| | | | |
|---|---|---|---|
| DE | 3620132 | | 9/1987 |
| DE | 3819173 | | 12/1989 |
| DE | 4411521 | | 10/1995 |
| DE | 4329652 | | 3/1998 |
| EP | 0051316 | | 5/1982 |
| EP | 2395161 | A1 | 12/2011 |
| EP | 2664722 | A2 | 11/2013 |
| GB | 2172627 | A | 9/1986 |
| GB | 2331529 | | 5/1999 |
| WO | WO 2012/021601 | | 2/2012 |
| WO | WO 2012/021606 | | 2/2012 |
| WO | WO 2012/021616 | | 2/2012 |
| WO | WO 2012/021623 | | 2/2012 |

* cited by examiner

DRAINAGE SYSTEM

FIELD OF THE INVENTION

This invention relates to a drainage system. In particular, the invention relates to a drainage system and method of installation, for providing drainage in a wet area such as a shower stall.

BACKGROUND OF THE INVENTION

Many different types of drainage systems for providing drainage in wet areas such as bathrooms, laundries and shower stalls have been proposed. One such drainage system is described in U.S. Pat. No. 6,799,606 B1. The drainage system described therein does not, however, comply with the building code in the United States.

Drainage systems commonly used in the United States have drainage conduits or pipes that are threaded and required to be screwed together for installation, or need to be adjusted in height by screwing one or more components relative to one another along screw threads. The present inventor has found that such screw thread drainage systems are tedious to install.

SUMMARY OF THE INVENTION

One or more embodiments of the present invention relate to a drainage system and method of installation, for providing drainage in a wet area such as a shower stall, which complies with the US building code and does not require threaded connections.

According to a first aspect of the invention, there is provided a drainage system having a central axis, said drainage system comprising:

(1) an outer drainage conduit adapted to extend within a subfloor of a wet area, said outer drainage conduit comprising:

a rim adapted to be secured to an upper surface of the subfloor, wherein the rim has an inlet for liquid and extends substantially laterally relative to the central axis; and a pipe body extending from the rim and having an outlet for liquid adapted to be connected to a waste pipe riser extending beneath the subfloor, wherein the central axis extends within the pipe body; and (2) an inner drainage conduit comprising:

a rim having an inlet for liquid and extending substantially laterally relative to the central axis; and a pipe body having an outlet for liquid and extending from the rim of the inner drainage conduit, and the central axis extends within the rim and pipe body of the inner drainage conduit, wherein:

the rim and pipe body of the inner drainage conduit are nestable within the outer drainage conduit, when nested, the pipe bodies and/or rims are adapted to be connectively sealed together using sealant, and when nested, the rims are adapted to hold a waterproofing membrane between the rims and to be connectively sealed in a water-tight manner to the waterproofing membrane using sealant or, in the absence of a waterproofing membrane, the rims are adapted to be connectively sealed together using sealant in a water-tight manner.

According to a preferred first aspect of the invention, there is provided a drainage system comprising:

(1) an outer drainage conduit adapted to extend within a subfloor of a wet area, said outer drainage conduit comprising:

a rim adapted to be secured to an upper surface of the subfloor, wherein the rim has an inlet for liquid; and a pipe body extending from the rim and having an outlet for liquid adapted to be connected to a waste pipe riser extending beneath the subfloor; and (2) an inner drainage conduit comprising:

a rim having an inlet for liquid; and a pipe body having an outlet for liquid and extending from the rim of the inner drainage conduit, wherein:

the rim and pipe body of the inner drainage conduit are nestable within the outer drainage conduit, when nested, the pipe bodies and/or rims are adapted to be connectively sealed together using sealant, and when nested, the rims are adapted to hold a waterproofing membrane between the rims and to be connectively sealed in a water-tight manner to the waterproofing membrane using sealant or, in the absence of a waterproofing membrane, the rims are adapted to be connectively sealed together using sealant in a water-tight manner.

The outer drainage conduit can be of any suitable size, shape and construction, and can be made of any suitable material or materials. Preferably the outer drainage conduit is of unitary construction. Preferably the outer drainage conduit is made of plastics material such as polypropylene, with antibacterial properties.

The outer drainage conduit can extend through any suitable type of subfloor. For example, the subfloor can be a timber/wooden subfloor or concrete subfloor. The outer drainage conduit can extend through a hole that has been previously installed in the timber/wooden subfloor or concrete subfloor. Alternatively, the outer drainage conduit can be cast within the subfloor at the time a concrete slab is poured to form the subfloor.

The rim can be adapted to be secured to the upper surface of the subfloor in any suitable way, for example using one or more fasteners and/or adhesive. In a preferred embodiment the rim includes one or more openings for receiving fasteners, such as screws or bolts. Such one or more openings can be recessed/countersunk such that the screws or bolts sit flush with an upper surface of the rim.

The rim can be of any suitable size and shape. The rim can extend substantially laterally relative to the central axis in any suitable way. In an embodiment, the rim can be in the form of a flange, such as a circular flange, that extends substantially laterally relative to the central axis. In an embodiment, the rim can be in the form of a ring or concentrically arranged inner and outer rings. In one embodiment, four openings can be positioned equidistantly around the rim.

The rim can have an upper surface, a sidewall extending downwardly from the upper surface and a lower surface situated opposite the upper surface. The rim can have one or more reinforcing structures such as one or more reinforcing ribs extending from the side wall and/or lower surface. Reinforcing ribs, for example, can extend from the sidewall and lower surface radially towards the central axis. In this way, the upper surface of the rim can be adequately supported at a location above the subfloor upper surface during installation and post-installation.

In an embodiment, an upper surface of the outer ring of the rim extends substantially perpendicularly relative to the central axis and an upper surface of an inner ring extends from the outer ring downwardly towards the central axis. The upper surface of the inner ring can extend at any suitable angle from the upper surface of the outer ring towards the central axis, preferably at a gentle slope enabling water run-off The pipe body of the outer drainage conduit can be of any suitable size and shape. The pipe body can be cylindrical and have an outer wall and inner wall, and the inner wall can face central axis. The outer and inner walls can extend substantially parallel with the central axis. The central axis preferably extends centrally of the pipe body.

The pipe body can have a lower pipe portion at which the outlet for liquid is located and an upper pipe portion between the lower pipe portion and rim that is of greater diameter than the lower pipe portion. The upper pipe portion can extend from the inner ring of the rim. The pipe body can have a stepped periphery.

The pipe body/lower portion can be adapted to be connected to the waste pipe riser in any suitable way. In an embodiment, the waste pipe riser friction fits within a free end of the lower pipe portion and sealant is used to fix the waste pipe riser within the free end. In this way, the lower pipe portion functions as a sleeve which contains an end of the waste pipe riser.

The pipe body can include a sloping sidewall or shoulder between the upper pipe portion and lower pipe portion. That is, the sloping sidewall or shoulder can angle/slope from the upper pipe portion towards the central axis to the lower pipe portion. The lower pipe portion can have an internally extending shoulder against which the waste pipe riser can abut when being fixed in place within the lower pipe portion. The internally extending shoulder can be situated where the upper pipe portion and lower pipe portion meet. The internally extending shoulder can be in the form of a circular flange or ring.

The inner drainage conduit can be of any suitable size, shape and construction, and can be made of any suitable material or materials. Preferably the inner drainage conduit is of unitary construction. Preferably the inner drainage conduit is made of plastics material such as polypropylene, with antibacterial properties.

The rim of the inner drainage conduit can be of any suitable size and shape. The rim can extend substantially laterally relative to the central axis in any suitable way. In an embodiment, the rim can in the form of a flange, such as a circular flange, that extends substantially laterally relative to the central axis. In an embodiment, the rim can be in the form of a ring or concentrically arranged inner and outer rings.

The rim can have an upper surface, a sidewall extending downwardly from the upper surface and a lower surface situated opposite the upper surface. The rim can be of minimum thickness.

In an embodiment, the outer ring of the rim extends substantially perpendicularly relative to the central axis and an inner ring extends from the outer ring downwardly towards the central axis. The inner ring can extend at any suitable angle from the outer ring towards the central axis, preferably at a gentle slope, but so as to encourage water run-off The pipe body of the inner drainage conduit can be of any suitable size and shape. The pipe body can be cylindrical and have an outer wall and inner wall, and the inner wall can face central axis. The outer and inner walls can extend substantially parallel with the central axis. The central axis preferably extends centrally of the pipe body.

The pipe body can have a lower pipe portion at which the outlet for liquid is located and an upper pipe portion that can extend from the inner ring of the rim.

The drainage system can comprise a height adjustable conduit comprising:

a rim having an inlet for liquid and extending substantially laterally relative to the central axis and adapted to be sealed with a removable closure, wherein the rim includes at least one drainage opening; and a pipe body having an outlet for liquid and extending from the rim of the height adjustable conduit, and the central axis extends within the pipe body of the height adjustable conduit, wherein the pipe body of the height adjustable conduit is nestable within the inner drainage conduit and friction fits to the pipe body of the inner drainage conduit such that the height adjustable conduit is slidable parallel with the central axis and relative to the pipe body of the inner drainage conduit.

Preferably, the drainage system comprises a height adjustable conduit comprising:

a rim having an inlet for liquid and adapted to be sealed with a removable closure, wherein the rim includes at least one drainage opening; and a pipe body having an outlet for liquid and extending from the rim of the height adjustable conduit, wherein the pipe body of the height adjustable conduit is nestable within the inner drainage conduit and friction fits to the pipe body of the inner drainage conduit such that the height adjustable conduit is slidable parallel relative to the pipe body of the inner drainage conduit.

The height adjustable conduit can be of any suitable size, shape and construction, and can be made of any suitable material or materials. Preferably the height adjustable conduit is of unitary construction. Preferably the height adjustable conduit is made of plastics material such as polypropylene, with antibacterial properties.

The rim of the height adjustable conduit can be of any suitable size and shape. The rim can extend substantially laterally relative to the central axis in any suitable way. In an embodiment, the rim can include a flange, such as a circular flange or ring that extends concentrically with the central axis. The circular flanged or ring can slope downwardly towards the central axis so as to encourage water run-off The rim can include an upstanding sidewall that extends substantially parallel with the central axis. The sidewall can extend upwardly from the flange, circular flange or ring. The sidewall can be annular in shape, such as the shape of a ring when viewed from above.

The rim can include one or more drainage openings, enabling the ingress of moisture or liquid into the pipe body of the height adjustable conduit once the drainage system has been installed (ie. for water seepage into the inner drainage conduit). The rim can have any suitable number of drainage openings, including one, two, three, four, five, six, seven, eight, nine or 10 openings, for example. These openings can be spaced equidistantly along the sidewall of the rim. Preferably, four openings are spaced equidistantly along the sidewall.

In an embodiment, a strainer or grate can be fitted to the rim of the height adjustable conduit. In an embodiment, the sidewall of the rim can receive and support a strainer or grate, such as a collar of a circular grate, or a draining pan of a strainer or grate. For example, a circular collar or draining pan of a strainer or grate may snugly fit within the sidewall of the rim.

The pipe body of the height adjustable conduit can be of any suitable size and shape, and can extend from the rim in any suitable way. The pipe body can be cylindrical and have an outer wall and inner wall, and the inner wall can face the central axis. The outer and inner walls can extend substantially parallel with the central axis. The central axis preferably extends centrally of the pipe body. The pipe body can extend from a flange, such as the circular flange or ring of the rim.

The pipe body can have a lower pipe portion at which the outlet for liquid is located and an upper pipe portion between the lower pipe portion and rim that is of greater diameter than the lower pipe portion. The upper pipe portion can extend from the flange or ring of the rim. The pipe body can have a stepped periphery.

The lower pipe portion can include a sloping sidewall or shoulder. That is, the sloping sidewall or shoulder can angle/slope towards the central axis.

The pipe body of the height adjustable conduit can friction fit to the pipe body of the second drainage conduit in any suitable way. In an embodiment, the height adjustable conduit includes a deformable skirt or at least one deformable flange that extends from the lower pipe portion of the pipe body and bears against the pipe body of the inner drainage conduit. In this way the height adjustable conduit is slidable parallel with the central axis and relative to the pipe body of the inner drainage conduit. The deformable skirt or flange can be of any suitable size, shape and construction. The deformable skirt or flange can provide spaces (weep holes) for water seepage into the inner drainage conduit.

The drainage system can comprise a removable closure for sealing the inlet for liquid of the rim of the height adjustable conduit as well as the at least one drainage opening.

The removable closure for sealing the rim of the height adjustable conduit can be of any suitable size, shape and construction. Preferably the closure is of unitary construction. Preferably the closure is made of plastics material such as polypropylene, with antibacterial properties.

In an embodiment, the removable closure can friction fit to the sidewall of the rim of the height adjustable conduit. This can be achieved in any suitable way. In an embodiment, the removable closure can seal the at least one drainage opening as well as the inlet for liquid of the rim of the height adjustable conduit.

In an embodiment, the closure is in the form of a cap having a top surface and a sidewall/collar which extends downwardly from the top surface. The top surface can extend substantially perpendicularly of the central axis whereas the sidewall can extend substantially parallel with the central axis. The sidewall/collar can be recessed relative to the top surface. The sidewall/collar can friction fit within the sidewall of the rim of the height adjustable conduit and prevent the ingress of dirt and debris into the height adjustable conduit. The cap can include openings in the top surface that are initially sealed with a thin plastic or paper liner, and that can be pierced using a finger or instrument. Once pierced, the openings can allow for easy removal of the cap from the rim of the height adjustable conduit, after installation/tiling has been completed.

The drainage system can comprise a grate or strainer that is connectable to the inlet for liquid of the rim of the height adjustable conduit.

The grate or strainer can be of any suitable size, shape and construction, and can be made of any suitable material or materials. Preferably the grate or strainer is made of plastics material and/or metal, such as polypropylene, stainless steel or chrome brass alloy.

In an embodiment, a strainer or grate can be fitted to the rim of the height adjustable conduit. In an embodiment, the sidewall of the rim can receive and support a strainer or grate, such as a collar of a circular grate, or a draining pan of a strainer or grate. For example, a circular collar or draining pan of a strainer or grate may snugly fit within the circular sidewall of the rim.

Following removal of the closure, the rim sidewall of the height adjustable conduit can receive a strainer such as a collar of a circular grate or a draining pan of a strainer. The closure can have overall dimensions similar to a round grate or strainer of the drainage system.

According to a second aspect of the invention, there is provided a method of installing a drainage system as defined according to the first aspect of the invention, said method comprising the steps of:

(1) positioning the outer drainage conduit such that it extends through a subfloor of a wet area requiring drainage;

(2) securing the rim of the outer drainage conduit to an upper surface of the subfloor;

(3) connecting the pipe body of the outer drainage conduit to a waste pipe riser extending beneath the subfloor, (4) installing a cement bedding floor to the height of the rim of the outer drainage conduit and allowing the bedding floor to set;

(5) optionally installing a waterproofing membrane over the bedding floor and outer drainage conduit but so as to not obstruct the inlet for liquid of the outer drainage conduit;

(6) optionally connectively sealing the waterproofing membrane between the rims of the outer and inner drainage conduits using sealant; and (7) connectively sealing the pipe bodies and/or rims together in a water-tight manner using sealant.

Note that not all of the steps need be carried out in the order listed above.

According to a preferred second aspect of the present invention, there is provided a method of installing a drainage system having a central axis, said drainage system comprising:

(1) an outer drainage conduit adapted to extend within a subfloor of a wet area, said outer drainage conduit comprising:

a rim adapted to be secured to an upper surface of the subfloor, wherein the rim has an inlet for liquid and extends substantially laterally relative to the central axis; and a pipe body extending from the rim and having an outlet for liquid adapted to be connected to a waste pipe riser extending beneath the subfloor, wherein the central axis extends within the pipe body; and (2) an inner drainage conduit comprising:

a rim having an inlet for liquid and extending substantially laterally relative to the central axis; and a pipe body having an outlet for liquid and extending from the rim of the inner drainage conduit, and the central axis extends within the rim and pipe body of the inner drainage conduit, wherein:

the rim and pipe body of the inner drainage conduit are nestable within the outer drainage conduit, when nested, the pipe bodies are adapted to be connectively sealed together using sealant, and when nested, the rims are adapted to hold a waterproofing membrane between the rims and to be connectively sealed in a water-tight manner to the waterproofing membrane using sealant or, in the absence of a waterproofing membrane, the rims are adapted to be connectively sealed together using sealant in a water-tight manner, said method comprising the steps of:

(1) positioning the outer drainage conduit such that it extends through a subfloor of a wet area requiring drainage;

(2) securing the rim of the outer drainage conduit to an upper surface of the subfloor;

(3) connecting the pipe body of the outer drainage conduit to a waste pipe riser extending beneath the subfloor, (4) installing a cement bedding floor to the height of the rim of the outer drainage conduit and allowing the bedding floor to set;

(5) installing a waterproofing membrane over the bedding floor and outer drainage conduit but so as to not obstruct the inlet for liquid of the outer drainage conduit;

(6) connectively sealing the waterproofing membrane between the rims of the outer and inner drainage conduits using sealant; and (7) connectively sealing the pipe bodies together in a water-tight manner using sealant.

Note that not all of the steps need be carried out in the order listed above.

According to another preferred second aspect of the present invention, there is provided a method of installing a drainage system, said drainage system comprising:

(1) an outer drainage conduit adapted to extend within a subfloor of a wet area, said outer drainage conduit comprising:

a rim adapted to be secured to an upper surface of the subfloor, wherein the rim has an inlet for liquid; and a pipe body extending from the rim and having an outlet for liquid adapted to be connected to a waste pipe riser extending beneath the subfloor; and (2) an inner drainage conduit comprising:

a rim having an inlet for liquid; and a pipe body having an outlet for liquid and extending from the rim of the inner drainage conduit, wherein:

the rim and pipe body of the inner drainage conduit are nestable within the outer drainage conduit, when nested, the pipe bodies are adapted to be connectively sealed together using sealant, and when nested, the rims are adapted to hold a waterproofing membrane between the rims and to be connectively sealed in a water-tight manner to the waterproofing membrane using sealant or, in the absence of a waterproofing membrane, the rims are adapted to be connectively sealed together using sealant in a water-tight manner, said method comprising the steps of:

(1) positioning the outer drainage conduit such that it extends through a subfloor of a wet area requiring drainage;

(2) securing the rim of the outer drainage conduit to an upper surface of the subfloor;

(3) connecting the pipe body of the outer drainage conduit to a waste pipe riser extending beneath the subfloor, (4) installing a cement bedding floor to the height of the rim of the outer drainage conduit and allowing the bedding floor to set;

(5) installing a waterproofing membrane over the bedding floor and outer drainage conduit but so as to not obstruct the inlet for liquid of the outer drainage conduit;

(6) connectively sealing the waterproofing membrane between the rims of the outer and inner drainage conduits using sealant; and (7) connectively sealing the pipe bodies together in a water-tight manner using sealant.

According to yet another preferred second aspect of the present invention, there is provided a method of installing a drainage system having a central axis, said drainage system comprising:

(1) an outer drainage conduit adapted to extend within a subfloor of a wet area, said outer drainage conduit comprising:

a rim adapted to be secured to an upper surface of the subfloor, wherein the rim has an inlet for liquid and extends substantially laterally relative to the central axis; and a pipe body extending from the rim and having an outlet for liquid adapted to be connected to a waste pipe riser extending beneath the subfloor, wherein the central axis extends within the pipe body; and (2) an inner drainage conduit comprising:

a rim having an inlet for liquid and extending substantially laterally relative to the central axis; and a pipe body having an outlet for liquid and extending from the rim of the inner drainage conduit, and the central axis extends within the rim and pipe body of the inner drainage conduit, wherein:

the rim and pipe body of the inner drainage conduit are nestable within the outer drainage conduit; and when nested, the rims and/or pipe bodies are adapted to be connectively sealed together using sealant in a water-tight manner, said method comprising the steps of:

connectively sealing the rims and/or pipe bodies together in a water-tight manner using sealant;

positioning the outer drainage conduit such that it extends through a subfloor of a wet area requiring drainage;

securing the rim of the outer drainage conduit to an upper surface of the subfloor;

connecting the pipe body of the outer drainage conduit to a waste pipe riser extending beneath the subfloor;

installing a cement bedding floor to the height of the rim of the outer drainage conduit and allowing the bedding floor to set; and installing a paintable waterproofing membrane over the bedding floor, rims of the outer and inner drainage conduits and partway into the pipe body of the inner drainage conduit.

Note that not all of the steps need be carried out in the order listed above.

Regarding step (1) or like step shown above, the outer drainage conduit can be positioned in any suitable way, through any suitable type of subfloor, in any suitable type of wet area requiring drainage. For example, the outer drainage conduit can be extended through a hole in a timber/wooden subfloor or concrete subfloor. For example, the outer drainage conduit can be cast within the subfloor at the time a concrete slab is poured to form the subfloor. For example, the wet area may be the floor of a bathroom, a shower recess/stall/area or any other wet area requiring drainage.

Regarding step (2) or like step, the rim of the outer drainage conduit can be secured to the subfloor in any suitable way. For example, one or more fasteners and/or adhesive can be used to secure the rim to the subfloor. In a preferred embodiment the rim includes one or more openings for receiving fasteners, such as screws or bolts.

Regarding step (3) or like step, this step need not occur between steps (1) and (2) or like steps. It can happen at a later stage.

The pipe body of the outer drainage conduit can be connected to the waste pipe riser in any suitable way. In an embodiment, the waste pipe riser friction fits within a free end of the pipe body and sealant is used to fix the waste pipe riser within the free end. An example of a suitable sealant is solvent cement (a solvent weld). Normally solvent cement would be used to connectively seal the waster pipe riser and pipe body.

Regarding step (4) or like step, any suitable type of cement bedding floor can be used in the method. For clarity, a cement bedding floor can be any cementitious material/mixture that hardens and provides the desired properties. For simplicity, cement bedding mixes are referred to herein. Examples of suitable cement bedding mixes are sold commercially and may comprise a mixture of cement, rock, gravel and/or sand. Normally the bedding floor would be installed to the height of the rim of the outer drainage conduit. Normally the bedding floor would be installed with a sloping surface so as to encourage collection of liquid at the inlet for liquid of the outer drainage conduit. Normally the bedding floor would be screeded to the height of the rim.

Regarding step (5) or like step, any suitable type of waterproofing membrane can be installed over the bedding floor and outer drainage conduit. Examples of suitable waterproofing membranes include a plastic liner or paintable water-proofing membrane. A bonding adhesive can be used. A suitable example is PVC sheeting/a shower pan liner sold under the trademark Oatley™ together with bonding adhesive sold under the trademark Oatley X-15™. If using a plastic liner, a circular hole can be cut into the liner so as overlap the rim of the outer drainage conduit but to not obstruct the inlet for liquid of the outer drainage conduit.

In an embodiment, if using paintable waterproofing membrane instead of a waterproofing plastic liner, the inner and outer conduits can be sealed together, preferably using a solvent weld, and the paintable waterproofing membrane can be painted onto the bedding floor as well as onto the rims of the inner and outer drainage conduits and further into a pipe body of the inner drainage conduit.

Regarding steps (5), (6) and (7) or like steps, these can be carried out simultaneously.

Regarding steps (6) and (7) or like steps, these can be carried out in either order.

Regarding step (6) or like step, the waterproofing membrane can be sealed between the rims of the outer and inner drainage conduits using any suitable type of sealant. Examples of suitable sealants include silicone sealant, such as the sealant sold under the trademark Sikaflex™. Normally a bead of silicone sealant would be extruded between the waterproofing membrane and rims. Normally a solvent weld (solvent cement) would be used to connectively seal the rims of the outer and inner drainage conduits together.

Regarding step (7) or like step, the pipe bodies and/or rims can be connectively sealed together in a water-tight manner using sealant in any suitable way. Normally a solvent weld would be used to connectively seal the pipe bodies and/or rims of the outer and inner drainage conduits together.

The method can further include a step prior to step (1) or like step of nesting the height adjustable conduit and inner drainage conduit within the outer drainage conduit together with the closure so as to prevent the ingress of debris into the outer drainage conduit or waste pipe riser. The method can further include a step of removing the nested height adjustable conduit and inner drainage conduit after carrying out step (1), steps (1) and (2), steps (1) to (3), or steps (1) to (4) or like steps.

The method can further include a step (8) or like step of nesting the height adjustable conduit (with or without the closure) within the inner drainage conduit and adjusting the height of the rim of the height adjustable conduit such that it coincides with a desired bedding floor height (screeding height) or finished floor height. The method can further include the step of sealing the inlet for liquid with the closure so as to prevent the ingress of debris into the outer drainage conduit or waste pipe riser.

The method can further include a step (9) or like step of installing a cement bedding floor to the height of the rim of the height adjustable conduit or near to the height of the rim of the height adjustable conduit (thereby allowing for floor tiles to be laid), and allowing the bedding floor to set. Any suitable type of cement bedding floor can be used in the method, including as described previously (ie. a mixture of cement, rock, gravel and/or sand). In a preferred embodiment the bedding floor can be installed near to the height of the rim of the height adjustable conduit, thereby allowing for floor tiles to be laid. Normally the bedding floor (and floor tiles) would be installed with a sloping surface so as to encourage collection of liquid at the inlet for liquid of the height adjustable conduit. Normally the bedding floor would be screeded to the height of the rim or near to the height of the rim of the height adjustable conduit. In this step, cement bedding floor mix can normally set around the rim of the height adjustable conduit, within the one or more drainage openings, and between the rims of the height adjustable conduit and inner drainage conduit—thereby permanently cementing the height adjustable conduit in position.

The method can further include a step of installing a metal mesh (galvanised reinforcement mesh or metal lath mesh) within a bedding floor or between bedding floors.

The method can further include a step (10) or like step of installing additional bedding mix/the balance of the bedding mix to fix the grate or strainer in place, particularly in instances where the grate or strainer stands proud of the rim of the height adjustable conduit. The bedding mix can be as described previously.

The method can further include a step (11) or like step of installing tiles to provide a desired floor finish.

The method can further include a step (12) or like step of removing the closure (if necessary) and connecting a grate or strainer to the inlet for liquid of the rim of the height adjustable conduit. The method can involve installing additional grout and/or tiling glue to fix the grate or strainer in place.

According to a third aspect of the invention, there is provided a drainage system having a central axis, said drainage system comprising:

(1) an outer drainage conduit adapted to extend within a subfloor, said outer drainage conduit comprising:

a rim adapted to be secured to an upper surface of the subfloor, wherein the rim has an inlet for liquid and extends substantially laterally relative to the central axis; and a pipe body extending from the rim and having an outlet for liquid adapted to be connected to a waste pipe riser extending beneath the subfloor, wherein the central axis extends within the pipe body; and (2) a height adjustable conduit comprising:

a rim having an inlet for liquid and extending substantially laterally relative to the central axis and adapted to be sealed with a removable closure, wherein the rim includes at least one drainage opening; and a pipe body having an outlet for liquid and extending from the rim of the height adjustable conduit, and the central axis extends within the pipe body of the height adjustable conduit, wherein the pipe body of the height adjustable conduit is nestable within the outer drainage conduit and friction fits to the pipe body of the outer drainage conduit such that the height adjustable conduit is slidable parallel with the central axis and relative to the pipe body of the outer drainage conduit.

The outer drainage conduit can be of any suitable size, shape and construction, and can be made of any suitable material or materials. Preferably the outer drainage conduit is of unitary construction. Preferably the first outer drainage conduit is made of plastics material such as polypropylene, with antibacterial properties.

The outer drainage conduit can extend through any suitable type of subfloor. For example, the subfloor can be a timber/wooden subfloor or concrete subfloor. The outer drainage conduit can extend through a hole that has been previously installed in the timber/wooden subfloor or concrete subfloor. Alternatively, the outer drainage conduit can be cast within the subfloor at the time a concrete slab is poured to form the subfloor.

The rim can be adapted to be secured to the upper surface of the subfloor in any suitable way, for example using one or more fasteners and/or adhesive. In a preferred embodiment the rim includes one or more openings for receiving fasteners, such as screws or bolts.

The rim can be of any suitable size and shape. The rim can extend substantially laterally relative to the central axis in any suitable way. In an embodiment, the rim can in the form of a flange, such as a circular flange, that extends substantially perpendicularly relative to the central axis. In an embodiment, the rim can be in the form of a ring or concentrically arranged inner and outer rings. In one embodiment, four openings can be positioned equidistantly around the rim.

The rim can have an upper surface, a sidewall extending downwardly from the upper surface and a lower surface situated opposite the upper surface. The rim can be of minimal thickness.

The pipe body of the outer drainage conduit can be of any suitable size and shape. The pipe body can be cylindrical and have an outer wall and inner wall, and the inner wall can face the central axis. The outer and inner walls can extend substantially parallel with the central axis. The central axis preferably extends centrally of the pipe body.

The pipe body can have a lower pipe portion at which the outlet for liquid is located, an intermediate pipe portion immediately adjacent the lower pipe portion that is of greater diameter than the lower pipe portion, and an upper pipe portion immediately adjacent the rim that is of greater diameter than the intermediate pipe portion. The upper pipe portion can extend from the ring of the rim. The pipe body can have a stepped periphery and a series of shoulders.

The pipe body/lower portion can be adapted to be connected to the waste pipe riser in any suitable way. In an embodiment, the waste pipe riser friction fits within a free end of the lower pipe portion and sealant is used to fix the waste pipe riser within the free end. In this way, the lower pipe portion functions as a sleeve which contains an end of the waste pipe riser.

The pipe body can include a sloping sidewall or shoulder between the upper pipe portion and intermediate pipe portion. That is, the sloping sidewall or shoulder can angle/slope from the upper pipe portion towards the central axis to the intermediate pipe portion. The lower pipe portion can have an internally extending shoulder against which the waste pipe riser can abut when being fixed in place within the lower pipe portion. The internally extending shoulder can be situated where the intermediate pipe portion and lower pipe portion meet. The internally extending shoulder can be in the form of a circular flange or ring.

The height adjustable conduit can have one or more features as described for the first and second aspects of the invention. The rim of the height adjustable conduit can rest against a shoulder extending between the upper and intermediate pipe portions, when fully nested within the outer drainage conduit.

The drainage system according to the third aspect of the invention can comprise a removable closure for sealing the inlet for liquid of the rim of the height adjustable conduit as well as the at least one drainage opening. The closure can have one or more features as described for the first and second aspects of the invention.

The drainage system according to the third aspect of the invention can comprise a strainer or grate that can be fitted to the rim of the height adjustable conduit. The grate or strainer can have one or more features as described for the first and second aspects of the invention.

According to a fourth aspect of the invention, there is provided a method of installing a drainage system as defined according to the third aspect of the invention, said method comprising the steps of:

(1) positioning the outer drainage conduit such that it extends through a subfloor of a wet area requiring drainage;

(2) securing the rim of the outer drainage conduit to an upper surface of the subfloor;

(3) connecting the pipe body of the outer drainage conduit to a waste pipe riser extending beneath the subfloor;

(4) installing a waterproofing membrane over the subfloor and over the rim of the outer drainage conduit but so as to not obstruct the inlet for liquid of the outer drainage conduit;

(5) adjusting the height of the rim of the height adjustable conduit such that it coincides with a desired bedding floor height; and (6) installing a cement bedding floor around the rim of the height adjustable conduit and allowing the bedding floor to set.

Regarding step (1), the outer drainage conduit can be positioned in any suitable way, through any suitable type of subfloor, in any suitable type of wet area requiring drainage. For example, the outer drainage conduit can be extended through a hole in a timber/wooden subfloor or concrete subfloor. For example, the outer drainage conduit can be cast within the subfloor at the time a concrete slab is poured to form the subfloor. For example, the wet area may be the floor of a bathroom, a shower stall or any other wet area requiring drainage.

Regarding step (2), the rim of the outer drainage conduit can be secured to the subfloor in any suitable way. For example, one or more fasteners and/or adhesive can be used to secure the rim to the subfloor. In a preferred embodiment the rim includes one or more openings for receiving fasteners, such as screws or bolts.

Regarding step (3), this step need not occur between steps (1) and (2). It can happen at a later stage. The pipe body of the outer drainage conduit can be connected to the waste pipe riser in any suitable way. In an embodiment, the waste pipe riser friction fits within a free end of the pipe body and sealant is used to fix the waste pipe riser within the free end. Normally a solvent weld would be used to connectively seal the waster pipe riser and pipe body.

Regarding step (4), any suitable type of waterproofing membrane can be installed over the subfloor and rim of the outer drainage conduit. Examples of suitable waterproofing membranes include a plastic/PVC liner or paintable waterproofing membrane. Such liners and sealants are sold under the trademark Oatley™ for example. If using a paintable water-proofing membrane, the paintable water-proofing membrane can be painted onto the subfloor as well as the rim of the outer drainage conduit and partway down the pipe body of the outer drainage conduit.

Regarding step (5), the height of the rim of the height adjustable conduit can be raised such that it coincides with a desired bedding floor height (screeding height). The method can further include the step of sealing the inlet for liquid with the closure so as to prevent the ingress of debris into the outer drainage conduit or waste pipe riser.

Regarding step (6), the cement bedding floor can be installed to the height of the rim of the height adjustable conduit or near to the height of the rim (so as to allow for the installation of floor tiles) and allowed to set. Any suitable type of cement bedding floor can be used in the method including as described previously. In an embodiment, the bedding floor would be installed near to the height of the rim of the height adjustable conduit, thereby allowing for floor tiles to be installed. Normally the bedding floor (and floor tiles) would be installed with a sloping surface so as to encourage collection of liquid at the inlet for liquid of the height adjustable conduit. Normally the bedding floor would be screeded to the height of the rim of the height adjustable conduit or just below the height of the rim if floor tiles are to be installed. In this step, cement bedding floor mix can normally set around the rim of the height adjustable conduit, within the one or more drainage openings, and between the rims of the height adjustable conduit and outer drainage conduit—thereby permanently cementing the height adjustable conduit in position.

The method can further include a step of installing a metal mesh (galvanised reinforcement mesh or metal lath mesh) within a bedding floor or between bedding floors.

The method can further include a step of installing additional bedding mix to fix the grate or strainer in place, particularly in cases where the grate or strainer stands proud of the rim of the height adjustable conduit. The bedding mix/bedding floor can be as described previously.

The method can further include a step of installing tiles to provide a desired floor finish.

The method can further include a step of removing the closure (if necessary) and connecting a grate or strainer to the inlet for liquid of the rim of the height adjustable conduit. The method can involve using additional grout and/or tiling glue to fix the grate or strainer in place.

The method can further include a step prior to step (1) or like step of nesting the height adjustable conduit within the outer drainage conduit together with the closure so as to prevent the ingress of debris into the outer drainage conduit or waste pipe riser. The method can further include a step of removing the nested height adjustable conduit after carrying out step (1), or steps (1) and (2) or like steps.

Any of the features described herein can be combined in any combination with any one or more of the other features described herein within the scope of the invention.

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows:

DETAILED DESCRIPTION

Figure 1:
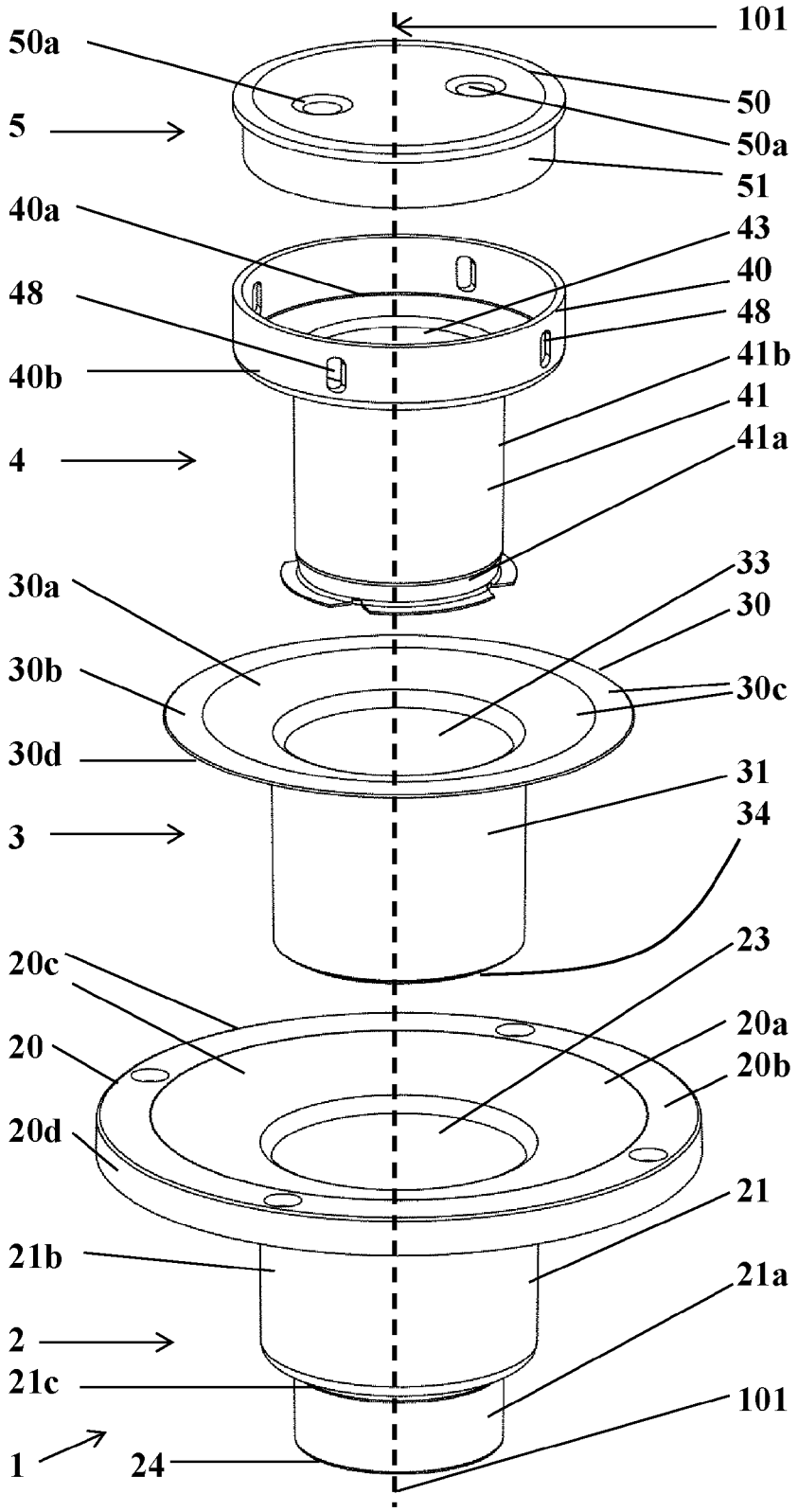
FIG. 1 is an exploded perspective view of a drainage system according to an embodiment of the present invention.
Figure 2:
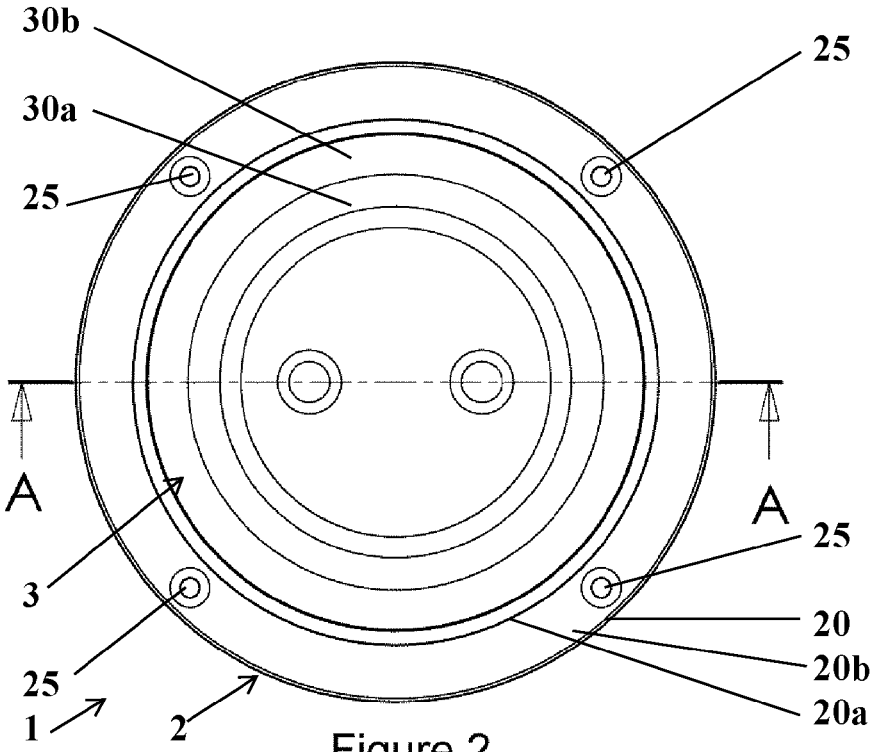
FIG. 2 is a top plan view of the drainage system shown in FIG. 1.

In the figures, like reference numerals refer to like features.

Figure 3:
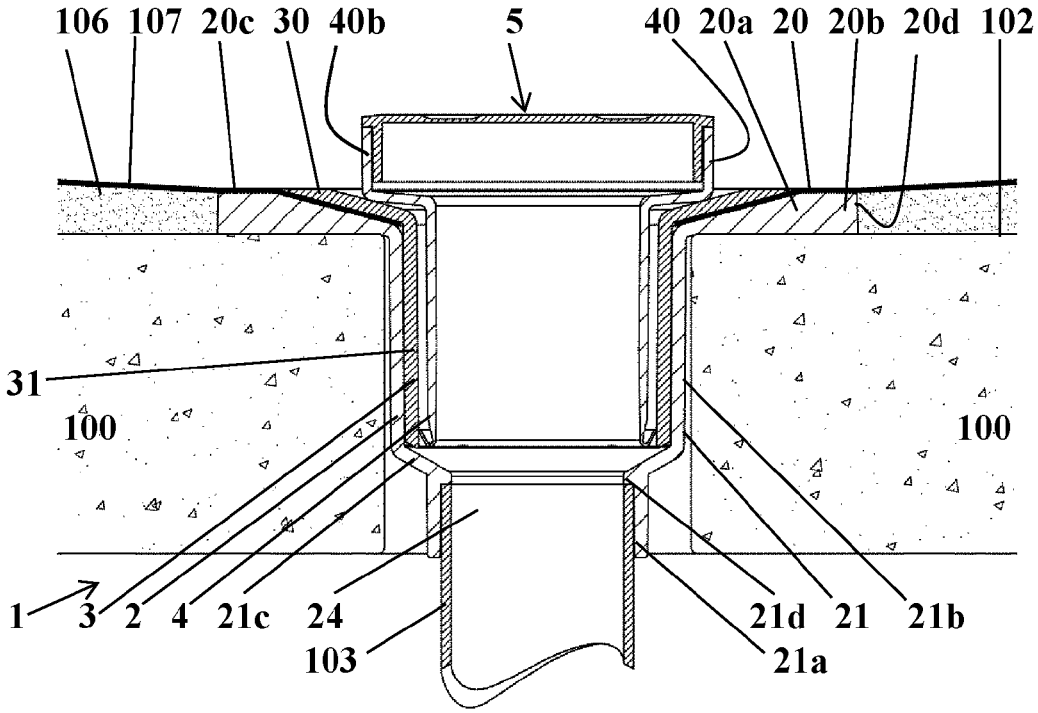
FIG. 3 is a cross sectional view of the drainage system shown in FIG. 2, taken through plane A-A.
Figure 4:
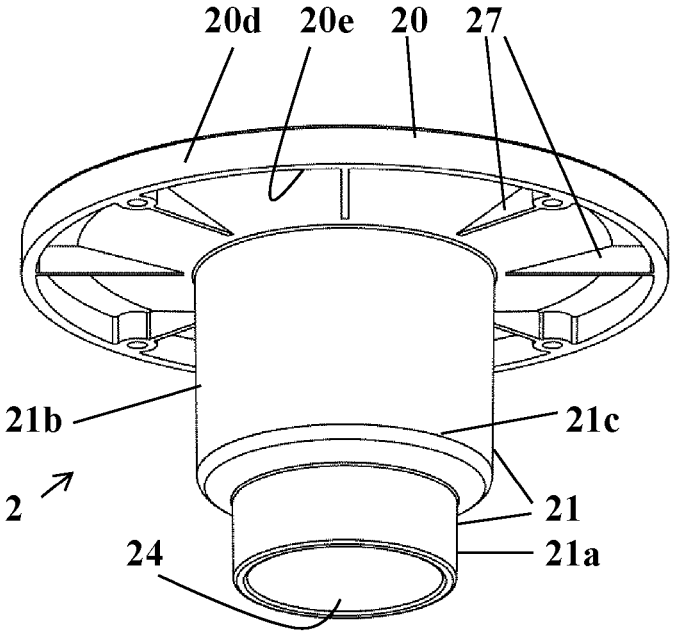
FIG. 4 is an underside perspective view of an outer drainage conduit of the drainage system shown in FIG. 1.
Figure 5:
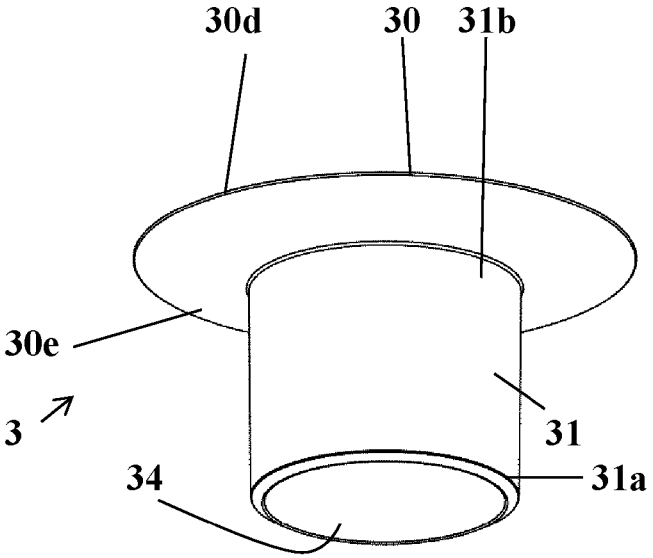
FIG. 5 is an underside perspective view of an inner drainage conduit of the drainage system shown in FIG. 1.
Figure 6:
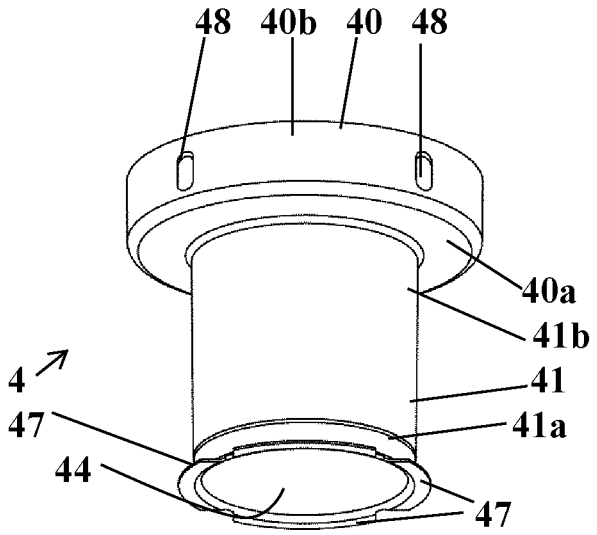
FIG. 6 is an underside perspective view of a height adjustable conduit of the drainage system shown in FIG. 1.
Figure 7:
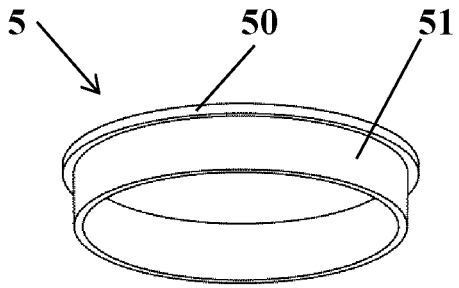
FIG. 7 is an underside perspective view of a closure of the drainage system shown in FIG. 1.
Figure 15:
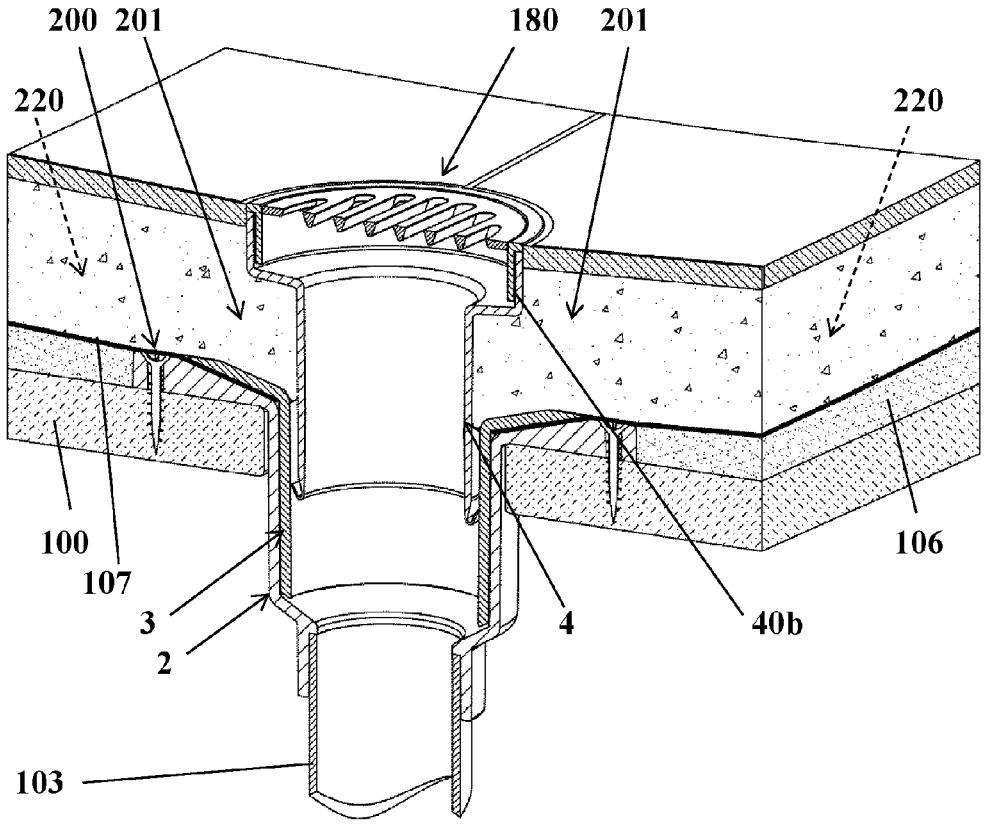
FIG. 15 is a cross sectional view of the drainage system shown in FIG. 1 when installed in a wet area.

Referring first to FIGS. 1 to 7, there is shown a first embodiment of a drainage system 1 for installation within a concrete or timber subfloor 100 (as seen in FIGS. 3 and 15). The drainage system 1 includes an outer drainage conduit 2 (3 inch×2 inch), an inner drainage conduit 3, a height adjustable conduit 4 and a closure 5. A central axis 101 is shown in exploded view FIG. 1 extending through the outer drainage conduit 2 (3 inch), inner drainage conduit 3, height adjustable conduit 4 (4 inch×3 inch) and removable closure 5 (4 inch).

The outer drainage conduit 2 includes a rim 20 which is adapted to be secured to an upper surface 102 of the subfloor 100. The rim 20 includes an inlet for liquid 23 and extends substantially laterally relative to the central axis 101. The outer drainage conduit 2 also includes a pipe body 21 extending from the rim 20 and is adapted to be connected to a waste pipe riser 103 (see FIG. 3) which extends beneath the subfloor 100. If a wooden subfloor 100, the pipe body 21 may extend through a 3.¾ inch diameter hole. The pipe body 21 includes an outlet 24 for liquid. The central axis 101 extends centrally within and through the rim 20 and pipe body 21. The outer drainage conduit 2 is of unitary construction and is made of polypropylene, with antibacterial properties.

The rim 20 is in the form of concentrically arranged inner 20*a* and outer 20*b* rings. Four countersunk openings 25 are positioned equidistantly around the outer ring 20*b* of the rim 20 and are able to receive screw fasteners 200 to secure the rim 20 to the subfloor 100.

The rim 20 has an upper surface 20*c*, a sidewall 20*d* extending downwardly from the upper surface 20*c* and a lower surface 20*e* situated opposite the upper surface 20*c*. The rim 20 has reinforcing ribs 27 extending from the sidewall 20*d* and lower surface 20*e* towards the central axis 101. In this way, the upper surface 20*c* of the rim 20 can be adequately supported at a location above the subfloor upper surface 102 during installation and post-installation.

The upper surface 20*c* of outer ring 20*b* extends substantially perpendicularly relative to the central axis 101 and the upper surface 20*c* of the inner ring 20*a* extends from the upper surface 20*c* of the outer ring 20*b* downwardly towards the central axis 101.

The pipe body 21 is cylindrical and has an outer wall and inner wall, and the inner wall faces the central axis 101. The outer and inner walls extend substantially parallel with the central axis 101. The pipe body 21 has a lower pipe portion 21*a* at which the outlet for liquid 24 is located, and an upper pipe portion 21*b* between the lower pipe portion 21*a* and rim 20 that is of greater diameter than the lower pipe portion 21*a*. The upper pipe portion 21*b* extends from the inner ring 20*a* of the rim 20. The pipe body 21 has a stepped periphery.

The waste pipe riser 103 friction fits within a free end of the lower pipe portion 21*a* and sealant is used to fix the waste pipe riser 103 within the free end.

The pipe body 21 include a sloping sidewall or shoulder 21*c* between the upper pipe portion 21*b* and lower pipe portion 21*a*. The lower pipe portion 21*a* has an internally extending shoulder 21*d* against which the waste pipe riser 103 abuts when being fixed in place within the lower pipe portion 21*a*. The internally extending shoulder 21*d* is in the form of a circular flange or ring.

The inner drainage conduit 3 includes a rim 30 that extends substantially laterally relative to the central axis 101. The rim 30 includes an inlet for liquid 33. The inner drainage conduit 3 also includes a pipe body 31 extending from the rim 30 and includes an outlet 34 for liquid. The central axis 101 extends centrally within and through the rim 30 and pipe body 31. The inner drainage conduit 3 is of unitary construction and is made of polypropylene, with antibacterial properties.

The rim 30 is in the form of concentrically arranged inner 30*a* and outer 30*b* rings. The rim 30 has an upper surface 30*c*, a sidewall 30*d* extending downwardly from the upper surface 30*c* and a lower surface 30*e* situated opposite the upper surface 30*c*.

The outer ring 30*b* extends substantially perpendicularly relative to the central axis 101 and the inner ring 30*a* extends from the outer ring 30*b* downwardly towards the central axis 101.

The pipe body 31 is cylindrical and has an outer wall and inner wall, and the inner wall faces the central axis 101. The outer and inner walls extend substantially parallel with the central axis 101. The pipe body 31 has a lower pipe portion 31*a* at which the outlet for liquid 34 is located, and an upper pipe portion 31*b* that extends from the inner ring 30*a* of the rim 30.

As seen in FIG. 3, the rim 30 and pipe body 31 of the inner drainage conduit 3 are nestable within the outer drainage conduit 2. When nested, the pipe bodies 21, 31 are adapted to be connectively sealed together using sealant. When nested, the rims 20, 30 are adapted to hold a waterproofing membrane 107 between the rims 20, 30 and to be connectively sealed in a water-tight manner to the waterproofing membrane 107 using sealant or, in the absence of a waterproofing membrane, the rims 20, 30 are adapted to be connectively sealed together using a solvent weld in a water-tight manner.

The height adjustable conduit 4 includes a rim 40 that extends substantially laterally relative to the central axis 101. The rim 40 includes a main inlet for liquid 43 and four drainage openings 48. The height adjustable conduit 4 also includes a pipe body 41 extending from the rim 40 and includes an outlet 44 for liquid. The central axis 101 extends centrally within and through the rim 40 and pipe body 41. The height adjustable conduit 4 is of unitary construction and is made of polypropylene.

The pipe body 41 is nestable within the inner drainage conduit 3 and friction fits to the pipe body 31 of the inner drainage conduit 3 such that the height adjustable conduit 4 is slidable parallel with the central axis 101 and relative to the pipe body 31 of the inner drainage conduit 3.

The rim 40 includes a circular flange 40*a* that extends from the pipe body 41 concentrically with the central axis 101. The circular flange 40*a* slopes downwardly towards the central axis 101 so as to encourage water run-off.

The rim 40 includes an upstanding sidewall 40*b* that extends substantially parallel with the central axis 101. The sidewall 40*b* extends upwardly from the circular flange 40*a*. The sidewall 40*b* is annular in shape when viewed from above.

The drainage openings 48 are spaced equidistantly along the sidewall 40*b* and enable the ingress of moisture or liquid into the pipe body 41 once the drainage system has been installed (as seen in FIG. 15).

Figure 8:
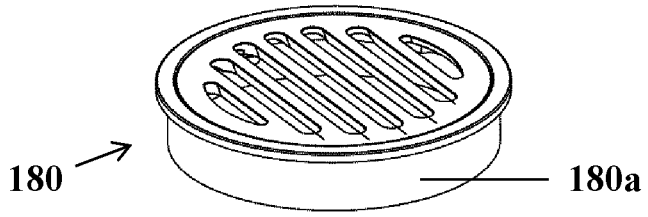
FIG. 8 is a perspective view of a grate or strainer of the drainage system, according to an embodiment of the present invention.
Figure 9:
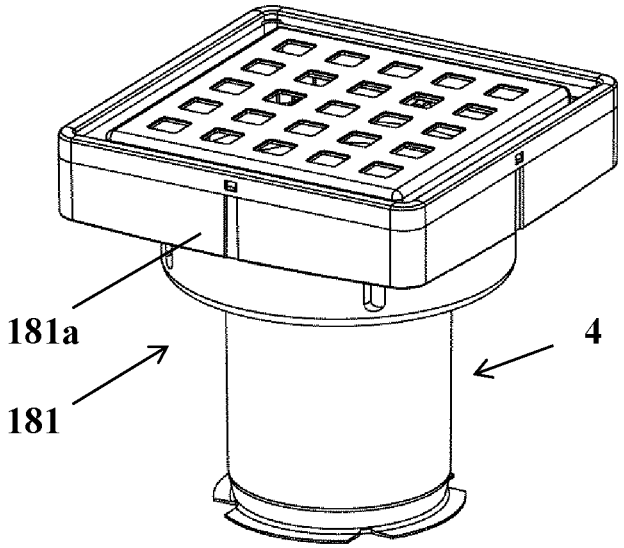
FIG. 9 is a perspective view of another type of grate or strainer of the drainage system, according to an embodiment of the present invention.

A strainer 180 or grate 181 (as seen in FIGS. 8 and 9) can be fitted to the rim 40, as seen in FIGS. 9 and 15. The sidewall 40*b* of the rim 40 can snugly receive and support the strainer or grate, such as a collar 180*a* of a circular grate 180, or a draining pan 181*a* of a strainer or grate 181.

The pipe body 41 is cylindrical and has an outer wall and inner wall, and the inner wall faces the central axis 101. The outer and inner walls extend substantially parallel with the central axis 101, and the central axis 101 extends centrally of the pipe body 41.

The pipe body 41 has a lower pipe portion 41*a* at which the outlet for liquid 44 is located, and an upper pipe portion 41*b* that is of greater diameter than the lower pipe portion 41*a*. The upper pipe portion 41*a* extends from the circular flange 40*a*. The pipe body 41 has a stepped periphery.

The lower pipe portion 41*a* includes a sloping sidewall or shoulder that slopes towards the central axis 101. The lower pipe portion 41*a* friction fits to the pipe body 31 of the inner drainage conduit 3 by way of a deformable skirt 47 (deformable flanges 47) that extends from the lower pipe portion 41*a* and bears against the pipe body 31 of the inner drainage conduit 3. (Spaces between the deformable flanges 47 act as weep holes such that water can seep into the pipe body 21.) In this way, the height adjustable conduit 4 is slidable parallel with the central axis 101 and relative to the pipe body 31. The rim 40 of the height adjustable conduit 4 can be raised relative to the other conduits 2, 3 such that cement bedding 201 may set around the rim 40 and to the height of the rim 40 or just below the height of the rim 40 (if floor tiles are to be installed), and between that rim 40 and the rim 31 of the inner drainage conduit 3 (as seen in FIG. 15).

The removable closure 5 can seal the inlet for liquid 43 of the rim 40 of the height adjustable conduit 4 as well as the four drainage openings 48 by friction fitting to the sidewall 40*b* of the rim 40.

The closure 5 is of unitary construction and is made of polypropylene.

The closure 5 is in the form of a cap 5 having a top surface 50 and a sidewall/collar 51 which extends downwardly from the top surface 50. The top surface 50 extends substantially perpendicularly of the central axis 101, whereas the sidewall 51 extends substantially parallel with the central axis 101. The sidewall/collar 51 is recessed relative to the top surface 50. The sidewall/collar 51 friction fits within the sidewall 40*b* of the rim 40 of the height adjustable conduit 4 and prevent the ingress of dirt and debris into the height adjustable conduit 4. The cap 5 includes two openings 50*a* in the top surface 50 that are initially sealed with a thin plastic or paper liner (not shown), and that can be pierced using a finger or instrument. Once pierced, the openings 50*a* can allow for easy removal of the cap 5 from the rim 40 of the height adjustable conduit 4, after installation/tiling has been completed (as seen in FIG. 15).

Figure 14:
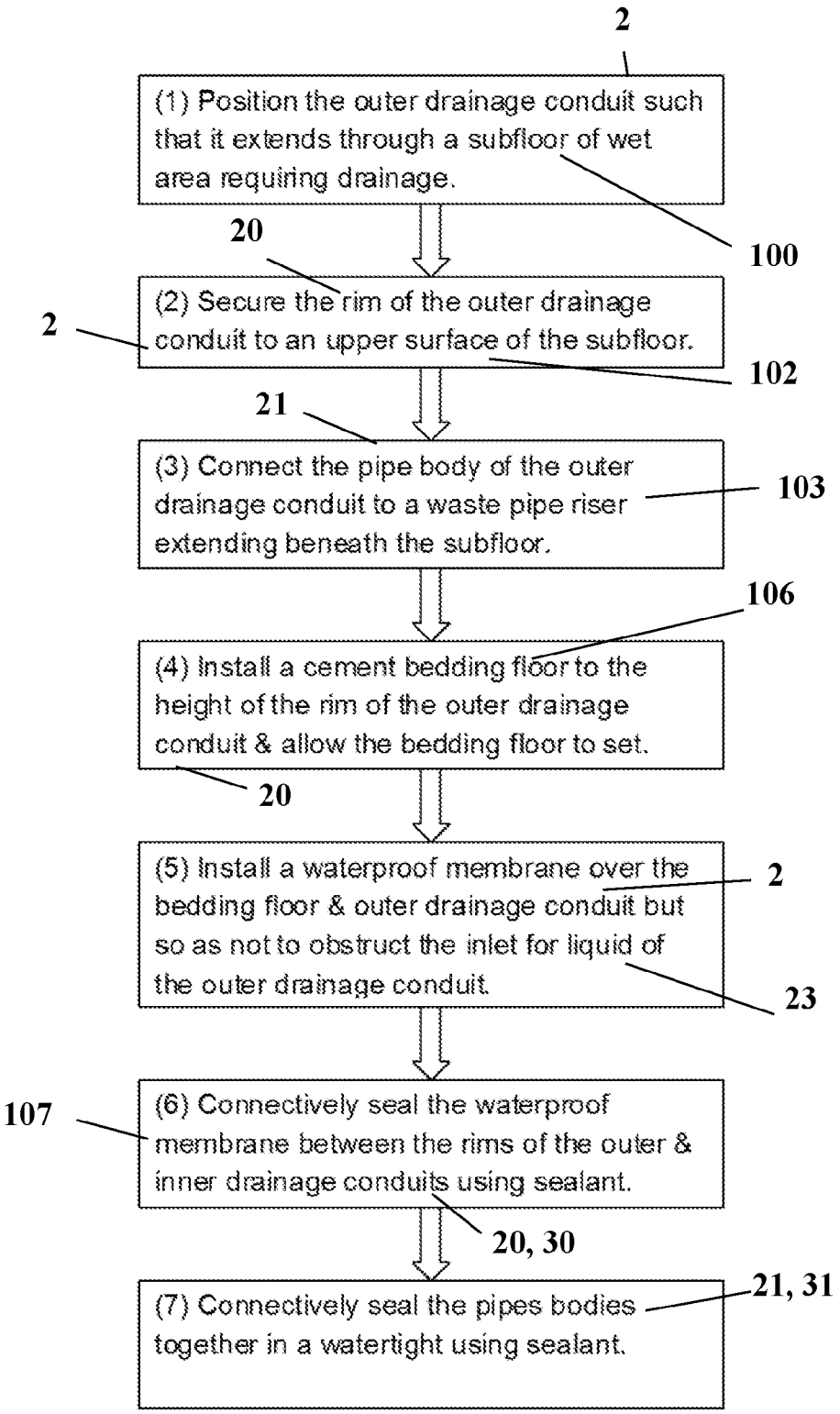
FIG. 14 is a flowchart explaining basic installation steps for the drainage system.

The drainage system 1 may be utilised in a wet area such as a bathroom, laundry or shower area as follows, with the basic steps being described in FIG. 14. As seen in FIGS. 3 and 15, the outer drainage conduit 2 is either installed in a pre-formed circular opening in a concrete or timber subfloor 100, or the conduit 2 is installed during the pouring of a concrete slab. Screws 200 are used to fasten the rim 20 of the conduit 2 to an upper surface 102 of the subfloor 100. During this step of installation, the inner drainage conduit 3 and height adjustable conduit 4 together with the cap 5 may be partially nested within the outer drainage conduit 2 so as to prevent the accidental ingress of debris (such as cement) into the conduit 2 or waste pipe riser 103 (substantially as shown in FIG. 3). The lower pipe portion 21*a* is designed to receive a 2 inch waste pipe riser 103 and to be welded thereto with solvent cement (solvent weld).

The rim 20 of the conduit 2 stands proud of the subfloor 100 so that a cement bedding floor 106 may be poured (as seen in FIGS. 3 and 15). The conduits 3 and 4 (with cap 5) are nested within the conduit 2 to prevent the accidental ingress of debris (as shown in FIG. 3). A cement bedding floor 106 is poured to the height of the rim 20 of the conduit 2, screeded and allowed to set/dry thoroughly. For wet areas such as showers, the bedding floor 106 is pre-sloped to encourage water to flow to the conduit 2. The other conduits 3, 4 are then removed from engagement with the conduit 2. A waterproofing liner/membrane 107 is extended and positioned over the bedding floor 106 and the conduit 2. A suitable liner is the PVC shower pan liner sold under the trademark Oatley, which is fixed in place using bonding adhesive (Oately X-15™). A circular hole (is cut in the liner 107 such that the liner 107 overlaps essentially the entirety of the upper surface 20*c* of the rim 20 of the conduit 2.

The conduit 3 is then used to sandwich/hold the liner 107 between the rims 20, 30 of the conduits 2, 3. The sloping rims 20, 30 enable the conduit 3 to be almost fully nested within the outer drainage conduit 2 even when holding the liner 107 between them. The rim 30 of the conduit 3 has been graded to allow for the positive draining of water from the liner 107. In practice, sealant, such as silicone sealant (½ inch bead), is applied to the upper surface 20*c* of the rim 20 of the conduit 2 and the lower surface 30*e* of the rim 30 of the conduit 3. Solvent cement (solvent weld) is applied to the inner wall of the pipe body 21 of the conduit 2 and outer wall of the pipe body 31 of the conduit 3 such that the conduits 2, 3 are welded together. After placing the liner 107 between the conduit rims 20, 30, the conduit 3 is forced into engagement with the conduit 2 with a slight twisting motion of the conduit 3. In effect, this creates a triple-seal connection between the rims 20, 30, the liner 107 and the conduits 2, 3.

At this stage, the shower pan liner and connection can be water tested. This may involve installing a 2 inch test plug or a 2 inch pump up test plug into the bottom of the 2 inch pipe connection, fill the shower pan liner with water to just below the top of the curb, and testing for approximately four hours. If any leaks, these can be repaired.

The triple seal connection is formed because of interlocking of: the lower surface of the rim 30*e* of the conduit 3 to a top side of the liner 107 via a bead of silicone sealant (first seal); an underside of the liner 107 to the upper surface 20*c* of the rim 20 of the conduit 2 via a bead of silicone sealant (second seal); and solvent welding of the pipe body 31 of the inner drainage conduit 3 to the pipe body 21 of the outer drainage conduit 2 (third seal). The third seal prevents waste water (such as shower wastewater) from flowing back up between the conduits 2, 3 which could otherwise undermine the liner connection and create leaks.

The height adjustable conduit 4 (with cap 5) is partially nested within the inner drainage conduit 3 and then raised to the appropriate height for bedding. The skirt 47 of the conduit 4 initially holds the conduit 4 at the desired height. An external of the rim 40 of the conduit 4 is partially or fully embedded with newly poured cement bedding 201 (as seen in FIG. 15), which bedding 201 may also incorporate a metal mesh (galvanised reinforcement mesh or metal lath mesh, generally in the areas labelled 220). The rim 40 of the conduit 4 is held in place by the bedding 201 and the bedding also penetrates the openings 48 in the rim 40 (which are sealed at an inner end of the openings 48 by the cap 5). The bedding 201 further fills any space between the lower surface 40*a* of the rim 40 and the upper surface 30*a* of the rim 30 of the inner drainage conduit 3. The pipe body 41 of the conduit 4 has an extended length so as to provide extra working height for floor bedding levels. If for example, floor tiles were to be laid, then the bedding would be laid to a height just below the top of the rim sidewall/collar 40*b* (to allow for tile thickness), so that the tiling can lay flush with an installed strainer or grate 180, 181 (or the top of the cap 5).

Cement bedding mix 201 and floor tiles 203 would be installed to provide the desired floor finish (as seen in FIG. 15). Following removal of the cap 5, the rim sidewall/collar 40*b* of the conduit 4 is able to receive a strainer or grate 180, 181. A collar 180*a* or draining pan 181*a* of the strainer or grate 180, 181 is snugly received within the rim sidewall/collar 40*b*, thereby creating a free-flowing connection between the tiled floor and waste pipe riser 103. The strainer or grate 180, 181 can be held in place within the rim 40 using additional grout and/or tiling glue.

If installing grate 181 of FIG. 9, then it would stand proud of the rim 40 and would need to be fixed in place with additional bedding mix.

Figure 10:
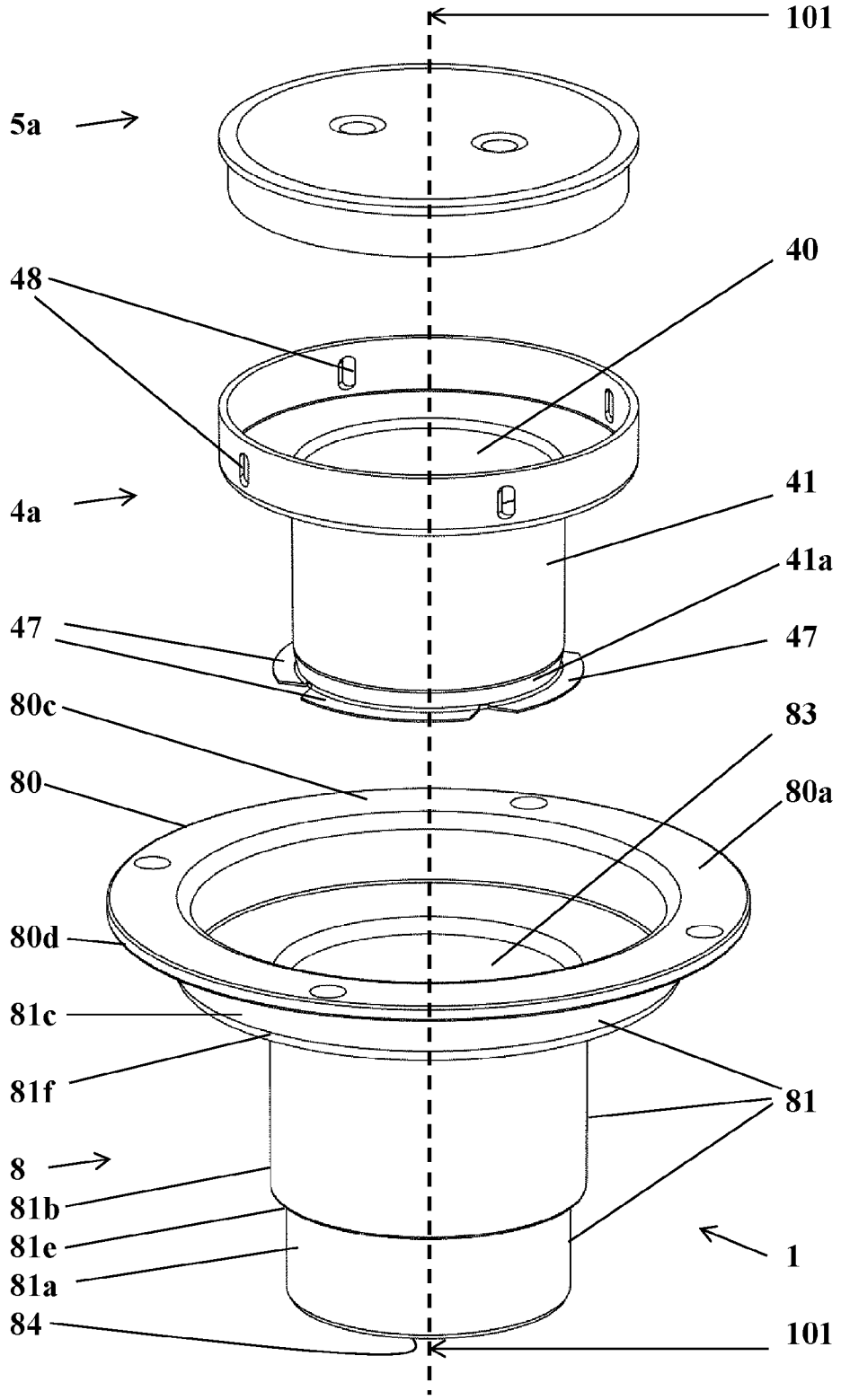
FIG. 10 is an exploded perspective view of a drainage system according to another embodiment of the present invention.
Figure 11:
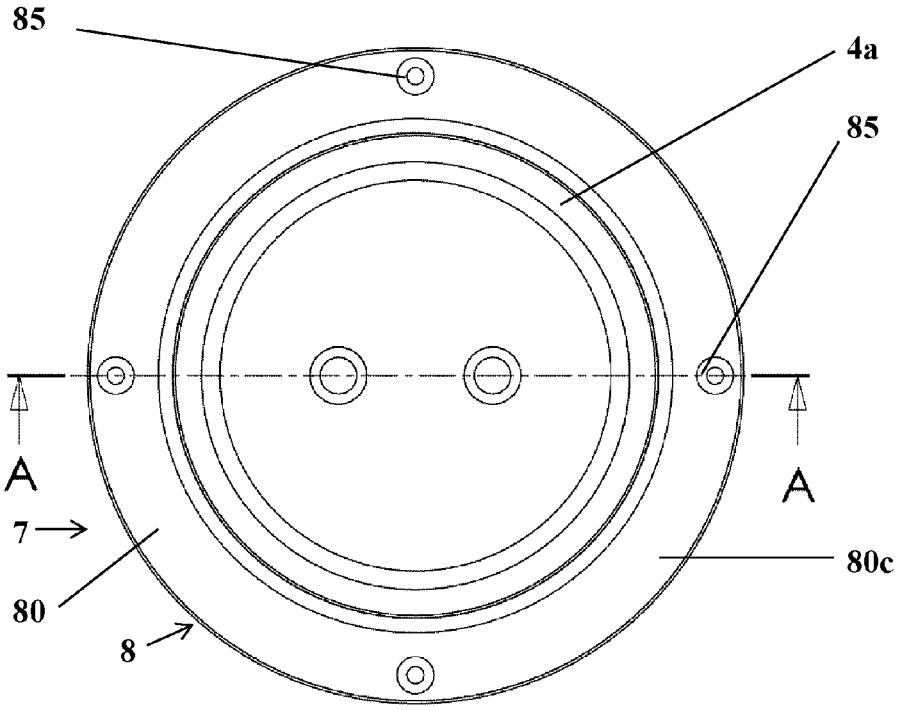
FIG. 11 is a top plan view of the drainage system shown in FIG. 10.

The drainage system has two-tier weep holes (openings 48 and between skirt flanges 47, as seen in FIG. 10), allowing for water seepage to escape into the waste pipe riser 103.

The drainage system 1 may also be utilised in a slightly different manner. The outer and inner drainage conduits 2, 3 are first solvent cement welded together and the outer drainage conduit 2 is fastened to the subfloor 102 using screws as described above.

The height adjustable conduit 4 (with cap 5) is nested within the inner drainage conduit 3 to prevent the accidental ingress of debris. Cement bedding 106 is poured and screeded to the height of the rims 20, 30 of the conduits 2, 3. Once dried, a paintable waterproofing membrane (liner) 107 is applied to the bedding as well as to upper surfaces 20*c*, 30*c* of the rims 20, 30 of the conduits 2, 3, and slightly further along the inner wall of the pipe body 31 of the inner drainage conduit 3.

The height adjustable conduit 4 (with cap 5) is then raised relative to the inner drainage conduit 3 and fixed in place with concrete bedding 201, as described above. The floor can then be finished/tiled as described above.

Referring now to FIGS. 10 to 13, there is shown a second embodiment of a drainage system 7 for installation within a concrete or timber subfloor 100. The drainage system 7 includes an outer drainage conduit 8, a height adjustable conduit 4*a* and a closure/cap 5*a*. The height adjustable conduit 4*a* and enclosure/cap 5*a* are substantially identical to the height adjustable conduit 4 and closure/cap 5. A central axis 101 is shown in exploded view FIG. 10 extending through the outer drainage conduit 8, height adjustable conduit 4*a* and cap 5*a*.

The outer drainage conduit 8 includes a rim 80 which is adapted to be secured to an upper surface 102 of the subfloor 100. The rim 80 includes an inlet for liquid 83 and extends substantially laterally relative to the central axis 101. The outer drainage conduit 8 also includes a pipe body 81 extending from the rim 80 and is adapted to be connected to a waste pipe riser 103 (see FIG. 12) which extends beneath the subfloor 100. The pipe body 81 includes an outlet 84 for liquid. The central axis 101 extends centrally within and through the rim 80 and pipe body 81. The outer drainage conduit 8 is of unitary construction and is made of polypropylene, with antibacterial properties.

The rim 80 is in the form of a ring 80*a*. Four openings 85 are positioned equidistantly around the ring 80*a* and are able to receive screw fasteners 200 to secure the rim 80 to the subfloor 100.

The rim 80 has an upper surface 80*c*, a sidewall 80*d* extending downwardly from the upper surface 80*c* and a lower surface 80*e* situated opposite the upper surface 80*c*. The upper and lower surfaces 80*c*, 80*e* of the ring 80*a* extend substantially perpendicularly relative to the central axis 101.

The pipe body 81 is cylindrical and has an outer wall and inner wall, and the inner wall mostly faces the central axis 101.

The pipe body 81 has a lower pipe portion 81*a* at which the outlet for liquid 84 is located, an intermediate pipe portion 81*b* immediately adjacent the lower pipe portion 81*a* that is of greater diameter than the lower pipe portion 81*a*, and an upper pipe portion 81*c* immediately adjacent the rim 80 that is of greater diameter than the intermediate pipe portion 81*b*. The upper pipe portion 81*c* extends downwardly from the ring 80*a* of the rim 80. The pipe body 81 has a stepped periphery and two shoulders 81*e*, 81*f*.

The waste pipe riser 103 friction fits within a free end of the lower pipe portion 81*a* and sealant/a solvent weld is used to fix the waste pipe riser 103 within the free end.

Shoulder 81*f* slopes from the upper pipe portion 81*c* towards the central axis 101 to the intermediate pipe portion 81*b*. The lower pipe portion 81*a* has an internally extending shoulder 81*h* against which the waste pipe riser 103 abuts when being fixed in place. The internally extending shoulder 81*h* is in the form of a circular flange or ring.

As mentioned for the other embodiment, a strainer 180 or grate 181 can be fitted to the rim 40 of the height adjustable conduit 4.

The rim 40 of the height adjustable conduit 4 can rest against the shoulder 81*f* extending between the upper 81*c* and intermediate 81*b* pipe portions, when fully nested within the outer drainage conduit 8. As with the other embodiment, the pipe body 41 friction fits to the pipe body 81 of the outer inner drainage conduit 8 by way of a deformable skirt 47 (deformable flanges 47, again providing weep holes there between) that extends from the lower pipe portion 41*a* and bears against the pipe body 81 of the outer drainage conduit 8. In this way, the height adjustable conduit 4 is slidable parallel with the central axis 101 and relative to the pipe body 81. The rim 40 of the height adjustable conduit 4 can be raised relative to the other conduit 8 such that concrete bedding may set around the rim 40 and to or near to the height of the rim 40, and between that rim 40 and the rim 80 and upper pipe portion 81*c* of the outer drainage conduit 8.

Figure 12:
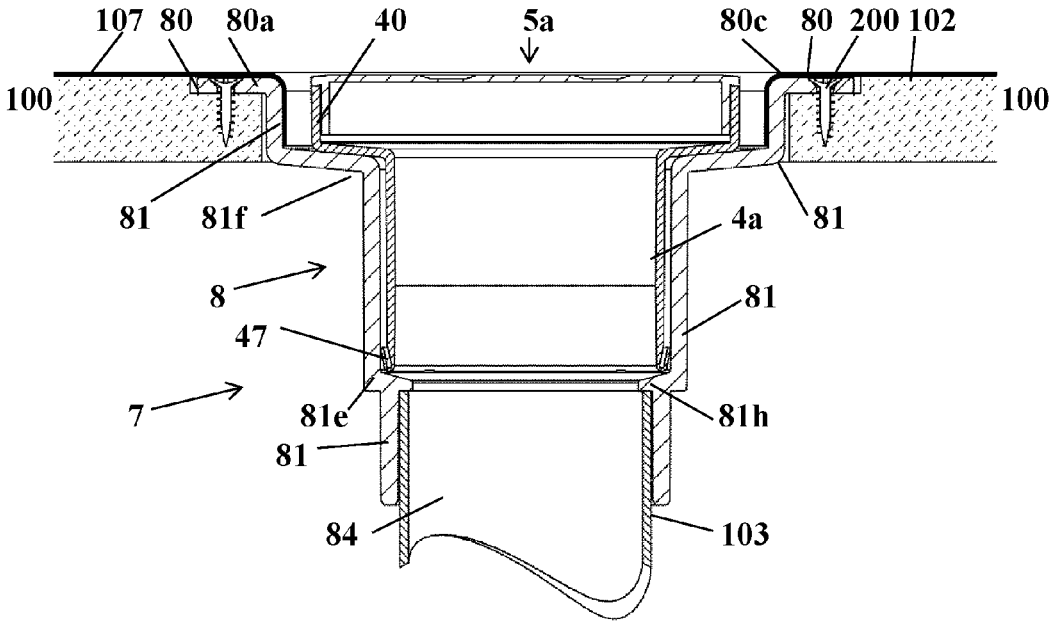
FIG. 12 is a cross sectional view of the drainage system shown in FIG. 11, taken through plane A-A.
Figure 13:
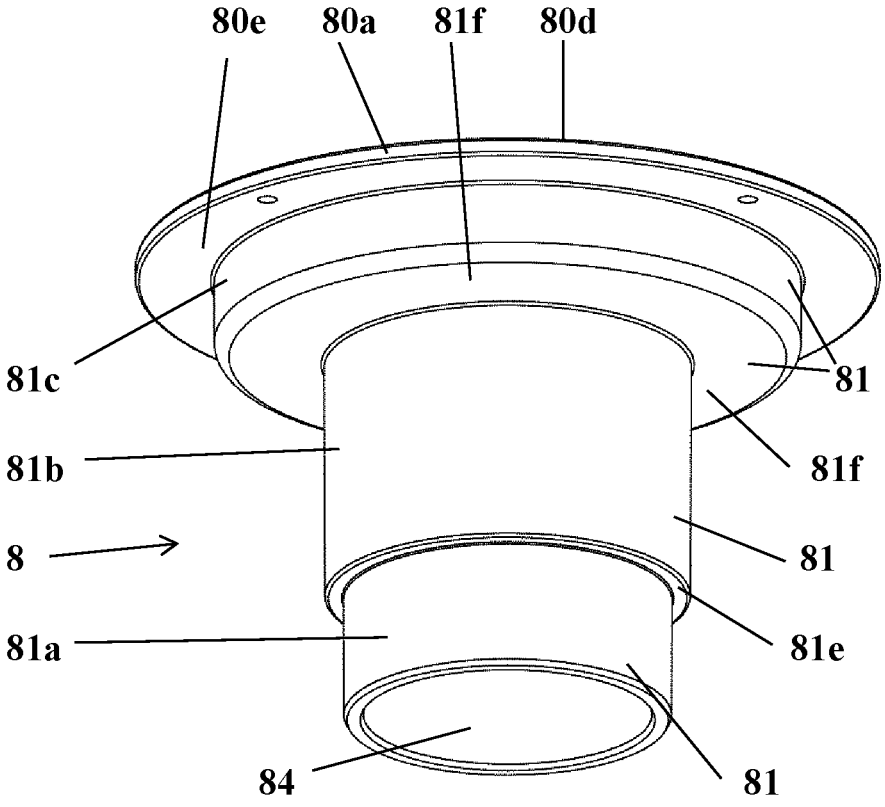
FIG. 13 is an underside perspective view of an outer drainage conduit of the drainage system shown in FIG. 10.

The drainage system 7 may be utilised in a wet area such as a bathroom, laundry or shower recess/stall as follows. The outer drainage conduit 8 is either installed in a pre-formed circular opening in a concrete or timber subfloor 100, or the conduit 8 is installed during the pouring of a concrete slab. Screws 200 are used to fasten the rim 80 of the first conduit 8 to the upper surface 102 of the subfloor 100, as seen in FIG. 12. During this step of installation, the height adjustable conduit 4*a* together with the cap 5*a* may be partially nested within the outer drainage conduit 8 so as to prevent the accidental ingress of debris (such as cement) into the first conduit 8 or waste pipe riser 103. The lower pipe portion 81*a* is designed to ultimately receive a 2 inch waste pipe riser 103 and to be welded thereto with solvent cement.

The rim 80 of the first conduit 8 stands slightly proud of the subfloor 100 or can extend within a recess as shown in FIG. 12.

A paintable waterproofing membrane (liner) 107 is applied to the subfloor upper surface 102 as well as to the upper rim surface 80*c* of the conduit 8, as well as further downwardly along upper pipe portion 81*c* towards the shoulder 81*f*.

The height adjustable conduit 4*a* (with cap 5*a*) is partially nested within the outer drainage conduit 8 and then raised to the appropriate height for bedding (substantially as shown in FIG. 15). The skirt 40*b* of the height adjustable conduit 4*a* initially holds that conduit 4 at the desired height. The rim 40 of the conduit 4 is partially or fully embedded with newly poured cement bedding, which bedding may also incorporate a metal mesh (galvanised metal mesh or metal lath mesh—not shown). The rim 40 is held in place by the bedding and the bedding also penetrates the openings 48 in the rim 40 (which are sealed at an inner end of the openings 48 by the cap 5*a*). The bedding further fills any space between an underside of the rim 40 and the rim 80*a* of the outer drainage conduit 8.

Concrete bedding mix and floor tiles would be installed to provide the desired finish (substantially as shown in FIG. 15). Following removal of the cap 5*a*, the rim 40 is able to receive a strainer such as a collar of a circular grate or a draining pan of a strainer (as seen in FIGS. 8 and 9). The collar or draining pan is snugly received within the rim of the height adjustable conduit 40, thereby creating a free-flowing connection between the tiled floor surface and waste pipe riser. The strainer or grate 180, 181 can be held in place within the rim 40 using additional grout and/or tiling glue.

If installing grate 181 of FIG. 9, then it would stand proud of the rim 40 and would need to be fixed in place with additional bedding mix.

The foregoing embodiments are illustrative only of the principles of the invention, and various modifications and changes will readily occur to those skilled in the art. The invention is capable of being practiced and carried out in various ways and in other embodiments. It is also to be understood that the terminology employed herein is for the purpose of description and should not be regarded as limiting.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

Any reference to a publication cited in this specification is not an admission that the disclosure constitutes common general knowledge.

The invention claimed is:

1. A method of installing a drainage system having a central axis, said drainage system comprising:

(1) an outer drainage conduit adapted to extend within a subfloor of a wet area, said outer drainage conduit comprising:

a rim adapted to be secured to an upper surface of the subfloor, wherein the rim has an inlet for liquid and extends substantially laterally relative to the central axis; and a pipe body extending from the rim and having an outlet for liquid adapted to be connected to a waste pipe riser extending beneath the subfloor, wherein the central axis extends within the pipe body; and (2) an inner drainage conduit comprising:

a rim having an inlet for liquid and extending substantially laterally relative to the central axis; and a pipe body having an outlet for liquid and extending from the rim of the inner drainage conduit, and the central axis extends within the rim and pipe body of the inner drainage conduit, wherein:

the rim and pipe body of the inner drainage conduit are nestable within the outer drainage conduit such that the pipe bodies are in direct contact with each other, when nested, the pipe bodies are adapted to be connectively sealed together using sealant, and when nested, the rims are adapted to hold a waterproofing membrane in the form of a liner between the rims and to be connectively sealed in a water-tight manner to the waterproofing membrane using sealant, said method comprising the steps of:

(1) positioning the outer drainage conduit such that it extends through a subfloor of a wet area requiring drainage;

(2) securing the rim of the outer drainage conduit to an upper surface of the subfloor;

(3) connecting the pipe body of the outer drainage conduit to a waste pipe riser extending beneath the subfloor;

(4) installing a cement bedding floor to the height of the rim of the outer drainage conduit and allowing the bedding floor to set;

(5) installing a waterproofing membrane in the form of a liner over the bedding floor and outer drainage conduit but so as to not obstruct the inlet for liquid of the outer drainage conduit;

(6) connectively sealing the waterproofing membrane between and to the rims of the outer and inner drainage conduits by applying sealant to both said rims; and (7) connectively sealing the pipe bodies together in a water-tight manner using sealant, wherein steps (1) to (7) need not be carried out in the order listed.

2. The method of claim 1, wherein the waterproofing membrane is a plastic liner.

3. The method of claim 1, wherein the waterproofing membrane is sealed between the rims of the outer and inner drainage conduits using silicone sealant.

4. The method of claim 1, wherein the pipe bodies are connectively sealed together in a water-tight manner using a solvent weld.

5. The method of claim 1, wherein the drainage system further comprises a height adjustable conduit comprising:

a rim having an inlet for liquid and extending substantially laterally relative to the central axis and adapted to be sealed with a removable closure, wherein the rim includes at least one drainage opening; and a pipe body having an outlet for liquid and extending from the rim of the height adjustable conduit, and the central axis extends within the pipe body of the height adjustable conduit, wherein the pipe body of the height adjustable conduit is nestable within the inner drainage conduit and friction fits to the pipe body of the inner drainage conduit such that the height adjustable conduit is slidable parallel with the central axis and relative to the pipe body of the inner drainage conduit, and the method further includes a step (8) of nesting the height adjustable conduit within the inner drainage conduit and adjusting the height of the rim of the height adjustable conduit such that it coincides with a desired bedding floor height.

6. The method of claim 5 further comprising a step of installing a cement bedding floor around the rim of the height adjustable conduit.

7. The method of claim 4, further comprising a step of installing a metal mesh within a bedding floor or between bedding floors.

8. The method of claim 4, further comprising a step of connecting a grate or strainer to the inlet for liquid of the rim of the height adjustable conduit.

9. The method of claim 4, further comprising a step of installing floor tiles to provide a desired floor finish.

10. The method of claim 1, further comprising a step of installing a test plug within a said drainage conduit, submersing the waterproofing membrane in water and testing for water leakage.

* * * * *